US010190267B2

(12) United States Patent
Verleyen et al.

(10) Patent No.: US 10,190,267 B2
(45) Date of Patent: Jan. 29, 2019

(54) ARTIFICIAL TURF FOR LANDSCAPE AND SPORTS

(71) Applicant: BFS EUROPE NV, Kruishoutem (BE)

(72) Inventors: Marc Henri Verleyen, Hulste (BE); Mathijs Marc Beauprez, Sint-Amandsberg (BE)

(73) Assignee: BFS EUROPE NV, Kruishoutem (BE)

( * ) Notice: Subject to any disclaimer, the term of this patent is extended or adjusted under 35 U.S.C. 154(b) by 438 days.

(21) Appl. No.: 14/105,298

(22) Filed: Dec. 13, 2013

(65) Prior Publication Data

US 2015/0167254 A1 Jun. 18, 2015

(51) Int. Cl.

| | |
|---|---|
| ***E01C 13/08*** | (2006.01) |
| ***D04H 11/08*** | (2006.01) |
| ***D05C 17/02*** | (2006.01) |
| ***D06N 7/00*** | (2006.01) |

(52) U.S. Cl.

CPC ..... *E01C 13/08* (2013.01); *D04H 11/08* (2013.01); *D05C 17/02* (2013.01); *D05C 17/023* (2013.01); *D05C 17/026* (2013.01); *D06N 7/0065* (2013.01); *D06N 7/0068* (2013.01); *D06N 2201/0254* (2013.01); *D10B 2503/042* (2013.01); *Y10T 428/23907* (2015.04); *Y10T 428/23936* (2015.04); *Y10T 428/23979* (2015.04)

(58) Field of Classification Search

CPC ..... E01C 13/08; D06N 7/0068; D06N 2201/0254; D06N 7/0065; D04H 11/08; Y10T 428/23979; Y10T 428/23936; Y10T 428/23907; D05C 17/02; D05C 17/023; D05C 17/026; D10B 2503/042

USPC ..... 428/95, 17

See application file for complete search history.

(56) References Cited

U.S. PATENT DOCUMENTS 2,505,176 A 4/1950 Elder
3,605,666 A * 9/1971 Kimmel et al. ..... D05C 17/02 112/410

(Continued)

FOREIGN PATENT DOCUMENTS

CA 1 165 990 A1 4/1984
CN 1401036 A 3/2003

(Continued)

OTHER PUBLICATIONS

International Search Report from PCT Application No. PCT/EP2014/077092, Apr. 20, 2015.

(Continued)

*Primary Examiner* — Cheryl Juska
(74) *Attorney, Agent, or Firm* — Workman Nydegger

(57) ABSTRACT

The present invention seeks to provide artificial turf that imitates more closely the root zone, the volume effect, and density of natural grass and that has an improved wear and drainage property. An artificial turf adapted for use in landscape and sports applications comprises a mechanically bounded layer of fibers formed as a non-woven matting made of one or more natural and/or synthetic fibers. A plurality of tufts of pile yarn is inserted through the mechanically bounded layer of fibers. A backing is applied at the backside of the mechanically bounded layer of fibers enhancing anchoring the tufts to the mechanically bounded layer of fibers.

13 Claims, 2 Drawing Sheets

(56) References Cited

U.S. PATENT DOCUMENTS 3,817,817 A * 6/1974 Pickens, Jr. et al. .. D05C 17/02 156/60
3,940,522 A * 2/1976 Wessells ..... D01D 5/253 156/72
3,975,224 A 8/1976 Ruzek et al.
4,053,668 A * 10/1977 Kimmel ..... D05C 17/02 112/410
4,140,071 A 2/1979 Gee et al.
4,426,415 A 1/1984 Avery
4,617,208 A 10/1986 Cadenhead, Sr.
4,756,941 A * 7/1988 McCullough ..... D01F 9/15 428/222
5,848,940 A 12/1998 Yamada
6,491,991 B2 12/2002 Seaton
6,723,412 B2 4/2004 Prevost
6,740,385 B2 * 5/2004 Gardner ..... B32B 5/06 28/107
7,670,661 B2 3/2010 Stroppiana
8,283,003 B2 * 10/2012 Morton-Finger ..... E01C 13/08 428/17
8,557,363 B2 * 10/2013 Van Balen ..... E01C 13/08 139/2
8,936,748 B2 * 1/2015 Morton-Finger ..... E01C 13/08 264/638
9,267,232 B2 * 2/2016 Gilman ..... B32B 3/085
2001/0033902 A1 10/2001 Seaton
2002/0028307 A1 3/2002 Prevost
2002/0132099 A1 9/2002 Squires
2002/0172795 A1 * 11/2002 Gardner ..... B32B 5/06 428/85
2003/0106741 A1 * 6/2003 Tompson ..... B29C 43/146 181/294
2003/0175474 A1 * 9/2003 Higgins ..... B32B 5/06 428/95
2003/0203152 A1 * 10/2003 Higgins ..... A47G 27/0293 428/92
2004/0137191 A1 * 7/2004 Beren ..... B32B 7/12 428/95
2005/0238433 A1 10/2005 Daluise
2006/0216458 A1 * 9/2006 Gilman ..... B32B 3/085 428/87
2007/0098925 A1 * 5/2007 Daluise ..... E01C 13/08 428/17
2007/0137017 A1 * 6/2007 Knox ..... E01C 13/08 29/428
2008/0044599 A1 2/2008 Stroppiana
2008/0124496 A1 * 5/2008 Avery ..... D05C 17/02 428/17
2009/0053460 A1 * 2/2009 Emirze ..... B32B 5/26 428/91
2009/0081406 A1 * 3/2009 Higgins ..... B32B 5/06 428/95
2009/0162578 A1 * 6/2009 Van Balen ..... E01C 13/08 428/17
2010/0055461 A1 * 3/2010 Daluise ..... E01C 13/08 428/403
2010/0062192 A1 * 3/2010 Morton-Finger ..... E01C 13/08 428/17
2012/0230777 A1 9/2012 Ayers et al.
2012/0305166 A1 * 12/2012 Morton-Finger ..... E01C 13/08 156/61
2015/0167254 A1 6/2015 Verleyen et al.
2017/0314191 A1 * 11/2017 Visscher ..... D06N 7/0068

FOREIGN PATENT DOCUMENTS

CN 1478957 A 3/2004
CN 101135133 A 3/2008
CN 202466355 U 10/2012
CN 102776820 A 11/2012
DE 24 52 136 A1 5/1976
DE 20 2005 013 023 U1 12/2006
EP 0966568 A1 12/1999
EP 1892331 A1 2/2008
EP 1988204 11/2008
GB 1145073 A 3/1969
GB 1154842 6/1969
GB 46353 A * 2/1982
GB 2135350 A 8/1984
GB 2 190 404 A 11/1987
GB 2 311 247 A 9/1997
NL 1016230 C2 3/2002
WO 98/40559 A1 9/1998
WO 01/37657 A1 5/2001
WO 03041822 A1 5/2003
WO 2007116290 A1 10/2007
WO 2012/125513 A1 9/2012

OTHER PUBLICATIONS

European Search Report from Application No. EP 13 19 7271, Apr. 17, 2014.
Chinese Office Action from CN Application No. 201480067685.X, dated Jan. 26, 2018.
United States Office Action from U.S. Appl. No. 15/103,469, dated Jun. 27, 2018.

* cited by examiner

ARTIFICIAL TURF FOR LANDSCAPE AND SPORTS

FIELD OF THE INVENTION

The present invention relates to surfaces simulating natural grass and, more specifically, to artificial turf imitating the volume effect and density of natural grass and manufacturing such turf.

BACKGROUND OF THE INVENTION

Artificial turf, also often referred to as synthetic grass, is a surface of synthetic fibers made to look like natural grass. It is most often used in sports applications. However, it is now being used on residential lawns and landscaping as well. Artificial turf stands up to heavy use and requires no irrigation or trimming. Domed, covered, and partially covered stadiums may require artificial turf because of the difficulty of getting grass enough sunlight to stay healthy. But, artificial turfs currently available still fail to provide the excellent shock absorbing properties of natural grass surfaces and also fall short in mimicking the volume effect of natural grass.

Today's generation artificial turfs are typically made from UV-enhanced polypropylene fiber or polyethylene fiber that is tufted into a woven synthetic primary backing that receives a secondary backing in form of a coating or laminate on the opposite side of the face fibers to give the turf dimensional stability and to aid fiber binding.

When installed, the turf's face (i.e., the grass "blades") is generally given a layer of sand to augment water drainage and/or a layer of cryogenic rubber granules to help keeping the tufts more vertically oriented and to provide shock-absorbency.

The infill typically provides ballast and structure for the artificial turf, helping the fibers to stand and to provide a "cushion" effect when stepping over the turf. This protects the roots of the tuft fibers.

Currently, non-infill artificial turf refers to those artificial turf models with short pile height, narrow gauge (distance between rows), and high stitch rate. Artificial turfs that are used without such infill are typically made from shorter, denser polyethylene fibers that include even shorter crimped fibers to keep the tufts resembling grass blades upright. Some non-infill systems provide an underlay under the turf to provide cushioning.

Due to an ever increasing number of residential and commercial applications of artificial turf, artificial turf with improved properties that more and more resemble natural grass is sought after, as illustrated in the following examples.

GB 1,154,842 discloses raised tufted, bonded fibrous structures. A fibrous web of desired weight and structure was placed on top of another such web and the assembled fibrous structure then needle punched in a conventional single bed needle loom. On passage through the needle loom, fibres from one fibrous web are carried by the needles through the other fibrous web as the foundation layer and the needle penetration is controlled so as to ensure that the aligned fibres pass through the foundation layer and project beyond its surface as fibre tufts.

WO 2001/037657 A1 discloses a vertically draining, rubber filled synthetic turf. The vertically draining synthetic turf comprises a porous geotextile membrane positioned between an open graded aggregate layer and a sand layer. The synthetic turf also includes a pile fabric comprising a plurality of pile elements tufted to a woven or non-woven backing above the open graded aggregate layer. An infill layer consisting of resilient particles, preferably a mixture of high and low density rubber, is interspersed among the pile elements of the pile fabric. The backing layer may be solely a non-woven, in a single layer or in multiple layers. A suitable non-woven, dimensionally stable material is a polyester/nylon blend, spun-bound, non-woven material.

WO 2012/125513 A1 discloses a synthetic ground cover system for erosion control to be placed atop the ground, which includes a synthetic grass comprising a composite of one or more geo-textiles tufted with synthetic yarns. The synthetic ground cover also includes a sand/soil infill ballast applied to the synthetic grass and a binding agent applied to the sand/soil infill to stabilize the sand/soil infill against high velocity water shear forces. The system includes a synthetic turf which includes a backing and synthetic turf blades secured to the backing. The synthetic grass blades are tufted into the substrate or backing comprising a synthetic woven or non-woven fabric. The backing can be a single ply backing or can be a multi-ply backing, as desired. A filter can be secured to the substrate to reinforce the substrate and better secure the synthetic grass blades. Preferably, the at least one filter fabric may also comprise non-woven synthetic fabric.

As more artificial turf and less natural grass is used to cover the ground for an increasing number of applications, it is increasingly important to provide artificial turf that is eco-friendly.

SUMMARY OF THE INVENTION

From the foregoing, it can be seen that there is a need for artificial turf that resembles more closely natural grass.

The present invention seeks to provide artificial turf for landscape and sports applications that imitates more closely the root zone, the volume effect, and density of natural grass and that has an improved wear and drainage property.

It is an advantage of embodiments of the present invention to provide the artificial turf with a mechanically bounded layer of fibers functioning as the root zone of natural grass that assists the pile yarn of the tufts to stand and that protects the bending points of the tufts such that the application of an infill can be eliminated. The mechanically bounded layer of fibers allows moving of the fiber so that compaction of the surface, thus hardening of the surface will be extensively be reduced.

It is another advantage of embodiments of the present invention that the artificial turf can be made from materials that are entirely recyclable thereby reducing the amount of waste that presently has to be disposed of in landfills.

It is still another advantage of embodiments of the present invention to enable surface water to drain easily in all directions to the ground underneath the installed artificial turf.

It is yet another advantage of embodiments of the present invention to provide artificial turf with a mechanically bounded layer of fibers for equalizing for uneven/rocky soils.

It is yet another advantage of embodiments of the present invention to provide artificial turf with a mechanically bounded layer of fibers that has shock absorbing properties and, thus, contributes to a more natural feeling of the artificial turf.

According to an aspect of the present invention, an artificial turf adapted for use in landscape and sports applications comprises a mechanically bounded layer of fibers made of one or more natural and/or synthetic fibers. Pile yarn is inserted through the mechanically bounded layer of fibers, the pile yarn being anchored to the mechanically bounded layer of fibers. The mechanically bounded layer of fibers has a density that decreases from the bottom to the top of the mechanically bounded layer of fibers.

By providing a mechanically bounded layer of fibers formed as a non-woven matting, surface water can drain easily to the soil underneath the artificial turf once installed. As a result, the artificial turf in accordance with advantageous embodiments of the present invention dries quickly provided drainage of the subsoil. By using a mixture of natural and, therefore, moisture absorbent fibers and synthetic fibers, the water holding capacity of the artificial turf can be improved compared to known prior art products.

According to preferred embodiments of the present invention, decrease in density occurs at a constant rate. As a result, the layer provides structural support for the tufts and shock-absorbance to contribute to a more natural feeling of the artificial turf.

According to preferred embodiments of the present invention, the mechanically bounded layer of fibers includes a lower layer and a upper layer, the lower layer being positioned at the bottom of the mechanically bounded layer of fibers and the upper layer being positioned on top of the lower layer, and the upper layer having a higher fiber coarseness than the lower layer.

The terms "upper" and "top", on the one hand, and "lower" and "bottom", on the other hand, are used herein to designate sides or portions of the artificial turf with reference to their relative positioning when the turf is deployed for normal use on a ground surface. Thus, "upper" and "top" refer to portions at or near the side from which free ends of the tufts stick out; and "lower" and "bottom" refer to portions at or near the opposite side.

This embodiment also provides structural support for the tufts and shock-absorbance to contribute to a natural feeling of the artificial turf, while allowing an efficient manufacturing process starting from two homogeneous non-woven mats having different fiber coarseness.

According to preferred embodiments of the present invention, the lower layer provides structural support for the pile yarn.

According to preferred embodiments of the present invention, the upper layer acts as a shock-absorbing layer and contributes to a natural feeling of the artificial turf.

According to preferred embodiments of the present invention, the lower layer is formed by fibers that are more flexible and form a denser structure than fibers forming the upper layer, the fibers of the lower layer having a smaller linear mass density than fibers forming the upper layer.

According to preferred embodiments of the present invention, the fibers of the lower layer have a linear mass density in the range of about 3.3 dtex to about 110 dtex.

According to preferred embodiments of the present invention, wherein the fibers of the upper layer have a linear mass density in the range of about 11 dtex to about 600 dtex.

According to preferred embodiments of the present invention, the upper layer is thicker and has a higher fiber coarseness than the lower layer.

According to preferred embodiments of the present invention, fill fibers are created on the upper surface of the upper layer through velour needle-punching, the fill fibers giving the upper surface of the upper layer a velour-like appearance, thereby imitating the root zone of natural grass, providing cushioning, and assisting the pile yarn of the tufts to stand. By velour-needle punching the upper surface of the upper layer, the surface is given a fluffy structure that provides cushioning. Since the fill fibers assist the pile yarn to stand, no infill, as often used in the known prior art is needed with the artificial turf in accordance with advantageous embodiments of the present invention.

According to preferred embodiments of the present invention, the mechanically bounded layer of fibers is manufactured as a single fabric or as two separate fabrics that are joined together.

According to preferred embodiments of the present invention, the mechanically bounded layer of fibers is formed by needle-punching.

According to preferred embodiments of the present invention, the mechanically bounded layer of fibers consists of up to eight different types of fibers.

According to preferred embodiments of the present invention, the mechanically bounded layer of fibers, the pile yarn, and a backing anchoring the pile yarn to the mechanically bounded layer of fibers are made of eco-friendly materials that are 100% recyclable by being mechanically deconstructable. It is furthermore advantageous to choose a homogenous polymer composition for all elements of the inventive artificial turf to support the recyclability.

According to an aspect of the present invention, a method for manufacturing artificial turf for use in landscape and sports applications comprises the steps of: forming by needle-punching a mechanically bounded layer of fibers having a density that decreases from the bottom to the top of the mechanically bounded layer of fibers; creating fill fibers extending the upper surface of the mechanically bounded layer of fibers through velour needle-punching, thereby giving the upper surface of the mechanically bounded layer of fibers a velour-like appearance; inserting pile yarn through the mechanically bounded layer of fibers; and anchoring the pile yarn at the backside of the mechanically bounded layer of fibers.

According to an aspect of the present invention, a method for manufacturing artificial turf for use in landscape and sports applications comprises the steps of: forming by needle-punching a lower layer from a plurality of natural and/or synthetic fibers; forming by needle-punching an upper layer from a plurality of natural and/or synthetic fibers that have a higher linear mass density than the fibers of the lower layer, the upper layer having a less dense structure than the lower layer; placing the upper layer on top of the lower layer to form a mechanically bounded layer of fibers; creating fill fibers on the upper surface of the upper layer through velour needle-punching thereby giving the upper surface of the upper layer a velour-like appearance; inserting pile yarn through the mechanically bounded layer of fibers; and anchoring the pile yarn at the backside of the mechanically bounded layer of fibers.

BRIEF DESCRIPTION OF THE DRAWINGS

The above and other characteristics, features, and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
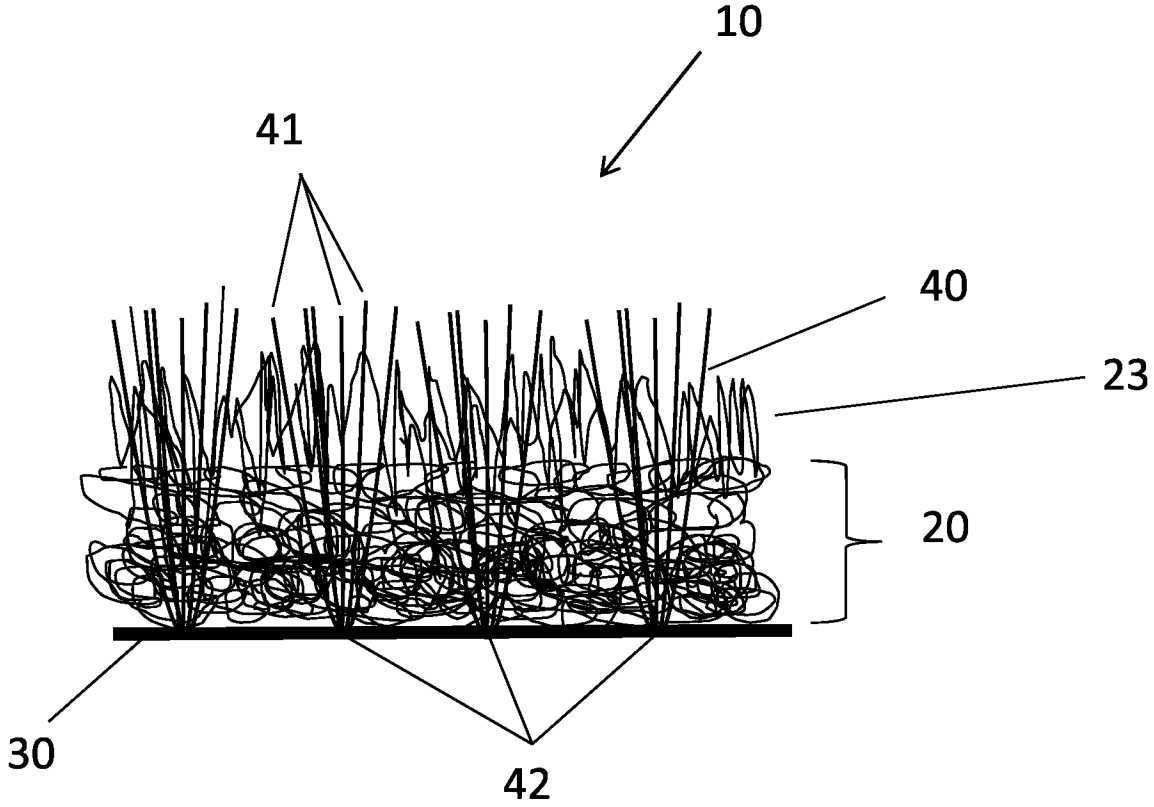
FIG. 1 is a schematic cross-sectional view of the artificial turf in accordance with a first preferred embodiment of the present invention.

The present invention will be described with respect to particular embodiments and with reference to certain drawings but the invention is not limited thereto but only by the claims. Any reference signs in the claims shall not be construed as limiting the scope. The drawings described are only schematic and are non-limiting. In the drawings, the size of some of the elements may be exaggerated and not drawn on scale for illustrative purposes.

Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures, or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures, and techniques have not been shown in detail in order not to obscure an understanding of this description.

The following terms or definitions are provided solely to aid in the understanding of the invention.

The term "backside" is used herein to denote the side of the mechanically bounded layer of fibers which faces away from the side from which free edges of the tufts stick out.

As employed herein, the term "fiber coarseness" is defined as weight per fiber length and is normally expressed in units of mg/m or g/m. The fiber coarseness depends on fiber diameter, cell wall thickness, cell wall density, and fiber cross section. A high coarseness value indicates a thick fiber wall, giving stiff fibers unable to collapse. Thin walled fibers with low coarseness value give flexible fibers and a denser structure. The coarser the fibers, the stronger they will be.

As employed herein, the term "tex" refers to a unit of measure for the linear mass density of fibers and is defined as the mass in grams per 1000 meters. The most commonly used unit is the decitex, abbreviated dtex, which is the mass in grams per 10,000 meters. When measuring objects that consist of multiple fibers the term "filament tex" is sometimes used, referring to the mass in grams per 1000 meters of a single filament.

As employed herein, the term "tufting" refers to a type of textile process in which a thread is inserted on a carrier base. Tufted carpets are manufactured by insertion of tufts (a short cluster of elongates strands of yarn attached at the base) through a backing fabric, creating a pile surface of cut and/or loop ends.

As employed herein, the term "filament" refers to a single continuous strand of natural or synthetic fiber.

As employed herein, the term "yarn" refers to a continuous strand of twisted or untwisted threads of natural or synthetic material.

As employed herein, the term "pile" refers to the visible surface (wearing surface) of carpet consisting of upright ends of yarn or yarn tufts in loop and/or cut configuration. Sometimes it is called "face" or "nap".

As employed herein, the term "backing" refers to a substrate applied to the back of the carpet to increase dimensional stability and enhances the anchoring of the pile yarn.

As employed herein, the term "non-woven" refers to engineered fabric (sheet or web structure) bonded together by entangling fibers mechanically, thermally, or chemically.

As employed herein, the term "needle-punch" refers to a mechanical process involving thousands of needles that orient and interlock fibers to create nonwoven fabric.

Referring to FIG. 1, the schematic cross-section of an artificial turf 10 is illustrated in accordance with preferred embodiments of the present invention. The artificial turf 10 includes a mechanically bounded layer of fibers 20, a backing 30, and a plurality of tufts 40.

The mechanically bounded layer of fibers 20 is formed as a non-woven matting made of one or more natural and/or synthetic fibers or yarns. The mechanically bounded layer of fibers 20 serves as a carrier for the tufts 40.

As illustrated in FIG. 1, the mechanically bounded layer of fibers 20 can be a single layer containing a mixture of fibers. According to preferred embodiments of the present invention, the coarseness of the fibers forming the mechanically bounded layer of fibers 20 may increase from the bottom to the top of the layer 20. For example, the coarseness may gradually increase at a constant rate.

Figure 2:
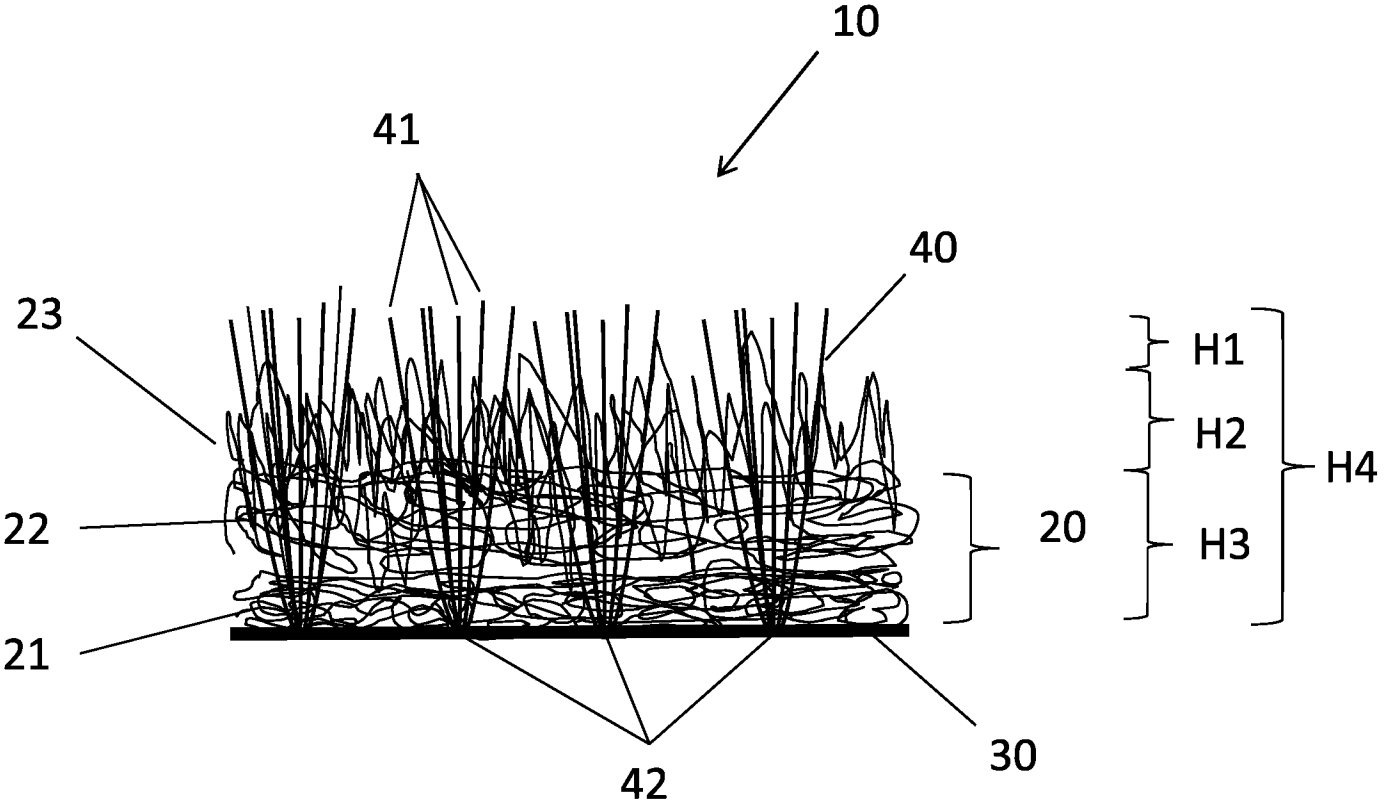
FIG. 2 is a schematic cross-sectional view of the artificial turf in accordance with a second preferred embodiment of the present invention.

Alternatively, as illustrated in FIG. 2, the mechanically bounded layer of fibers 20 can include visually two or more layers, such as, a structural layer 21 and a volume simulating layer 22. The structural layer 21 is positioned at the bottom of the mechanically bounded layer of fibers 20 facing away from the pile yarn 41. The volume simulating layer 22 is positioned on top of the structural layer 21 facing the pile yarn 41. In case of multiple layers of fibers, the mechanically bounded layer of fibers is divided into multiple functionalities, such as, for example, structural enhancements (layer 21) and volume simulating (layer 22).

The mechanically bounded layer of fibers 20 can be manufactured as a single fabric or as two separate fabrics that are joined together. In accordance with preferred embodiment of the present invention, the mechanically bounded layer of fibers 20 is formed by needle-punching. During this mechanical bonding method, fibers are transported with felting needles and interlocked in the non-woven structure. This procedure increases the friction between the fibers, which reinforces the non-woven fabric. To differentiate the structure of the non-woven fabric, the web can be further structured using special machines equipped with structuring fork or crown needles. The surface can be structured as a velour or rib, or with geometrical or linear patterns. Needle-punching is an ecologically friendly technology, as it permits the use of recycled material including that from polyethylene terephthalate bottles and regenerated fibers from apparel, as well as natural fibers. It may be possible to use other technologies to form non-woven fabrics to obtain the mechanically bounded layer of fibers 20.

The mechanically bounded layer of fibers 20 may consist of up to eight different types of fibers. Each of the fibers can have a different color, if desired. The types of fibers can include moisture absorbent fibers, such as coco, cotton, jute, wool, rayon or other natural or synthetic fibers. The types of fibers can further include synthetic fibers, such as polypropylene (PP), polyethylene (PE), polyamides (PA), and polyester (PES) or a combination thereof. The fibers can be treated, for example, with anti-algae, with herbicide, UV-stabilizer, or to be anti-static. The fibers can be melt fibers. The fibers can among others further include mineral based fibers, animal based fibers, or plant based fibers.

If the mechanically bounded layer of fibers 20 is formed as a single layer, as shown in FIG. 1, a mixture of relatively thin walled fibers that are flexible and form a relatively dense structure and, thus, having a relatively low coarseness value and relatively thick walled fibers that are stiff and form a relatively sparse structure and, thus, having a relatively low coarseness value is used in combination. In an exemplary embodiment of the invention, the density of the mechanically bounded layer of fibers 20 can gradually decrease from the bottom to the top of the layer 20. Accordingly, the coarseness of the fibers will gradually increase from the bottom to the top of the layer 20. By designing the mechanically bounded layer of fibers 20 that way, structural support for the tufts 40 and protection for bending points 42 of the tufts 40 is provided as well as shock-absorbance to contribute to a more natural feeling of the artificial turf 10.

If, according to preferred embodiments of the present invention, the mechanically bounded layer of fibers 20 is formed as a single layer, as shown in FIG. 2, the structural layer 21 is formed by relatively thin walled fibers that are flexible and form a relatively dense structure. Accordingly, fibers with the relatively low linear mass density (dtex value) are selected for the structural layer 21. The structural layer 21 is utilized for anchoring the tufts 40. The structural layer 21 provides dimensional stability for the artificial turf 10 and protection for the bending points 42 of the tufts 40. The fibers of the structural layer 21 have preferably a linear mass density in the range of about 3.3 dtex to about 110 dtex, and more preferably of about 11 dtex.

The volume simulating layer 22 is formed by fibers having a larger linear mass density than the fibers of the structural layer 21. The fibers of the volume simulating layer 22 have preferably a linear mass density in the range of about 11 dtex to about 600 dtex, and more preferably of about 110 dtex. Consequently, the volume simulating layer 22 has also a higher fiber coarseness (weight per fiber length) than the structural layer 21. A high coarseness value indicates a thick fiber wall, giving stiff fibers unable to collapse. Therefore, the volume simulating layer 22 of the mechanically bounded layer of fibers 20 is thicker and coarser than the structural layer 21. Fibers with a higher dtex value are selected for the volume simulating layer 22 so that the mechanically bounded layer of fibers 20 can act as a shock-absorbing layer and contribute to a natural feeling of the artificial turf 10.

In addition, the fibers of the mechanically bounded layer of fibers 20 can be given a velour effect by needling to mimic the root zone volume effect of natural grass. Due to a mechanical needling process, fiber is pushed out of the upper surface of the layer 20. Velour needle-punched non-woven material can be produced by placing an non-woven material on a brush-like stitch base and needling of the non-woven material on this stitch base. Since with this method the fibers seized by the needles are needled into the bristles or lamellas of the needle stitch base, the non-woven material needled in this way is given a velour-like appearance where the fiber stands out above the surface.

By velour needle-punching the mechanically bounded layer of fibers 20, fill fibers 23 are created. The fill fibers 23 are punched out of the non-woven fibrous matting of the mechanically bounded layer of fibers 20 creating a natural grass like root zone. The fill fibers 23 give the upper surface of the mechanically bounded layer of fibers 20 (facing the pile yarn 41) a fluffy appearance and provide cushioning. The fill fibers 23 also assist the pile yarn 41 of the tufts 40 to stand. Thus, no infill, as often used with prior art artificial turf, is needed with the artificial turf 10 in accordance with preferred embodiments of the present invention.

Strands of pile yarn 41 form each tuft 40. A tuft 40 is a short cluster of elongates strands of pile yarn 41 attached at the base, the bending point 42. The tufts 40 are inserted through the mechanically bounded layer of fibers 20. Tufting usually is accomplished by inserting reciprocating needles threaded with pile yarn 41 into the mechanically bounded layer of fibers 20 to form tufts 40 of yarn. Loopers or hooks, typically working in timed relationship with the needles, are located such that the loopers are positioned just above the needle eye when the needles are at an extreme point in their stroke through the mechanically bounded layer of fibers 20. When the needles reach that point, pile yarn 41 is picked up from the needles by the loopers and held briefly. Loops or tufts 40 of yarn result from passage of the needles back through the mechanically bounded layer of fibers 20. This process typically is repeated as the loops move away from the loopers due to advancement of the backing through the needling apparatus. Subsequent, the loops can be cut to form a cut pile, for example, by using a looper and knife combination in the tufting process to cut the loops.

The pile yarn 41 can consist of up to four different types of yarns. Each yarn can have a different color, if desired. The pile yarn 41 can be monofilament, tape or a combination thereof. The pile yarn 41 has preferably a linear mass density of about 400 dtex to about 3000 dtex and, more preferably of about 1600 dtex. The number of strands of pile yarn 41 in a tuft 40 is between 2 and 10, and preferably 6. The tuft gauge (distance between rows) is between ½" and 1/16" and typical ⅜" or 3/16" or ⅛". The stitch rate of the tufting is between 8/10 cm and 30/10 cm and preferably 12/10 cm.

In accordance with preferred embodiments of the invention and as shown in FIG. 2, the mechanically bounded layer of fibers 20 may have a height H3 of about 3 mm to about 15 mm, and more preferably about 8 mm. The fill fibers 23 may extend from the upper surface of the mechanically bounded layer of fibers 20 for a height H2 of about 1 mm to about 20 mm, and more preferably of about 10 mm. The pile yarns 41 may extend from the fill fibers 23 for about 1 mm to about 20 mm, and more preferably 10 mm (height H1). The total height H4 of the artificial turf 10 may be about 10 mm to about 60 mm, and more preferably about 28 mm.

The backing 30 is applied to the mechanically bounded layer of fibers 20 as a last finishing step to enhance the anchoring of the tufts to the mechanically bounded layer of fibers 20. In accordance with preferred embodiments of the present invention the backing 30 can be a coated backing such as, for example, a polyethylene (PE) backing that is applied by means of powder or hot melt coating. The backing 30 can further be a calander backing or latex backing.

In the finishing operation, the backside or stitched surface of the mechanically bounded layer of fibers 20 is coated with an adhesive, such as a natural or synthetic rubber or resin latex or emulsion or a powder or hot melt adhesive, to enhance locking or anchoring of tufts 40 to the mechanically bounded layer of fibers 20. Use of such further improves dimensional stability of the tufted turf 10, resulting in more durable turf. Further stabilization can be provided in the finishing operation by laminating, for example, a thermoplastic film or a woven or nonwoven fabric made from polypropylene, polyethylene, or ethylene-propylene copolymers or natural fibers such as jute, to the tufted mechanically bounded layer of fibers 20. The adhesive bonds the mechanically bounded layer of fibers 20 to the backing 30.

To provide an eco-friendly artificial turf 10 in accordance with preferred embodiments of the present invention the mechanically bounded layer of fibers 20, the tufts 40, and the backing 30 may all be made of materials that are recyclable, such as, for example, 100% polyolefin.

Other arrangements for accomplishing the objectives of embodiments of the present invention will be obvious for those skilled in the art. It is to be understood that although preferred embodiments, specific constructions and configurations, as well as materials, have been discussed herein for devices according to the present invention, various changes or modifications in form and detail may be made without departing from the scope and spirit of this invention.

The invention claimed is:

1. An artificial turf comprising:

a mechanically bounded layer of fibers consisting of non-woven matting comprising one or more natural and/or synthetic fibers, and pile yarn inserted through the mechanically bounded layer of fibers, the pile yarn being anchored to the mechanically bounded layer of fibers, wherein the mechanically bounded layer of fibers has a density that decreases from the bottom to the top of the mechanically bounded layer of fibers, and wherein the mechanically bounded layer of fibers is on top of a backing, and the mechanically bounded layer of fibers includes a lower layer an an upper layer, the lower layer being positioned at the bottom of the mechanically bounded layer of fibers and the upper layer being positioned on top of the lower layer, and the upper layer having a higher fiber coarseness than the lower layer.

2. The artificial turf according to claim 1, wherein fill fibers extending the upper surface of the mechanically bounded layer of fibers is created through velour needle-punching, the fill fibers giving the upper surface of the mechanically bounded layer of fibers a velour structure of fibers standing out above the upper surface, thereby providing structural support for the pile yarn by assisting the pile yarn to stand, imitating the root zone of natural grass, and providing cushioning.

3. The artificial turf according to claim 1, wherein the lower layer is a structural layer that is utilized for anchoring the pile yarn and that provides dimensional stability.

4. The artificial turf according to claim 1, wherein the upper layer is a volume simulating layer that acts as a shock-absorbing layer and contributes to a natural feeling of the artificial turf.

5. The artificial turf according to claim 1, wherein the lower layer is formed by fibers that are more flexible and form a denser structure than fibers forming the upper layer, the fibers of the lower layer having a smaller linear mass density than the fibers forming the upper layer.

6. The artificial turf according to claim 5, wherein the fibers of the lower layer have a linear mass density in the range of about 3.3 dtex to about 110 dtex.

7. The artificial turf according to claim 5, wherein the fibers of the upper layer have a linear mass density in the range of about 11 dtex to about 600 dtex.

8. The artificial turf according to claim 1, wherein the mechanically bounded layer of fibers is manufactured as a single fabric or as two separate fabrics that are joined together.

9. The artificial turf according to claim 1, wherein the mechanically bounded layer of fibers is formed by needle-punching.

10. The artificial turf according to claim 1, wherein the mechanically bounded layer of fibers consists of up to eight different types of fibers.

11. The artificial turf according to claim 1, wherein the mechanically bounded layer of fibers, the pile yarn, and the backing enhancing the anchoring of the pile yarn to the mechanically bounded layer of fibers are made of eco-friendly materials that are 100% recyclable by being mechanically deconstructable.

12. The artificial turf according to claim 1, wherein the mechanically bounded layer of fibers, the pile yarn, and the backing are made of 100% polyolefin.

13. A method for manufacturing artificial turf for use in landscape and sports applications, the artificial turf comprising:

a mechanically bounded layer of fibers consisting of non-woven matting comprising one or more natural and/or synthetic fibers, and pile yarn inserted through the mechanically bounded layer of fibers, the pile yarn being anchored to the mechanically bounded layer of fibers, wherein the mechanically bounded layer of fibers has a density that decreases from the bottom to the top of the mechanically bounded layer of fibers, and wherein the mechanically bounded layer of fibers is on top of a backing, and the mechanically bounded layer of fibers includes a lower layer an an upper layer, the lower layer being positioned at the bottom of the mechanically bounded layer of fibers and the upper layer being positioned on top of the lower layer, and the upper layer having a higher fiber coarseness than the lower layer;

the method comprising the steps of:

forming by needle-punching a lower layer from a plurality of natural and/or synthetic fibers;

forming by needle-punching an upper layer from a plurality of natural and/or synthetic fibers that have a higher fiber coarseness than the fibers of the lower layer, the upper layer having a less dense structure than the lower layer;

placing the upper layer on top of the lower layer to form the mechanically bounded layer of fibers;

creating fill fibers extending the upper surface of the upper layer through velour needle-punching thereby giving the upper surface of the upper layer a velour structure of fibers standing out above the upper surface;

inserting the pile yarn through the mechanically bounded layer of fibers; and anchoring the pile yarn at the backside of the mechanically bounded layer of fibers.

* * * * *